United States Patent [19]

Tamai et al.

[11] 3,986,968

[45] Oct. 19, 1976

[54] MILLED AND POLAR SOLVENT EXTRACTED LIQUID DEVELOPER

[75] Inventors: Yasuo Tamai; Hajime Miyatuka, both of Tokyo, Japan

[73] Assignee: Rank Xerox Ltd., London, England

[22] Filed: Feb. 1, 1974

[21] Appl. No.: 438,897

[52] U.S. Cl. ..... 252/62.1 L; 96/1 LY; 427/15; 427/17; 106/309

[51] Int. Cl.[2] ..... G03G 9/12

[58] Field of Search ..... 252/62.1; 96/1 LY; 117/37 LE; 106/309; 427/15, 17

[56] References Cited

UNITED STATES PATENTS

| | | | |
|---|---|---|---|
| 2,772,982 | 12/1956 | Vesce | 106/309 X |
| 2,907,674 | 10/1959 | Metcalfe et al. | 252/62.1 X |
| 3,032,432 | 5/1962 | Metcalfe et al. | 252/62.1 X |
| 3,257,322 | 6/1966 | Wright | 252/62.1 |
| 3,392,018 | 7/1968 | Metcalfe et al. | 252/62.1 X |
| 3,399,140 | 8/1968 | Fischer | 252/62.1 |
| 3,522,181 | 7/1970 | Garrett et al. | 252/62.1 |
| 3,551,337 | 12/1970 | Robinson | 117/37 LE X |
| 3,558,342 | 1/1971 | Tanno et al. | 117/37 LE |
| 3,623,986 | 11/1971 | Machida et al. | 252/62.1 |
| 3,694,239 | 9/1972 | Simon | 106/309 |

*Primary Examiner*—Roland E. Martin, Jr.

[57] ABSTRACT

A liquid developer composition is given whereby a mixture of pigment and resin is milled and washed prior to being dispersed in the carrier liquid.

5 Claims, No Drawings

MILLED AND POLAR SOLVENT EXTRACTED LIQUID DEVELOPER

This invention relates to imaging systems, and more particularly, to improved developer materials.

The formation and development of images on the surface of photoconductive materials by electrostatic means is well known. The basic electrostatographic process, as taught by Carlson in U.S. Pat. No. 2,297,691, involves placing a uniform electrostatic charge on a photoconductive insulating layer, exposing the layer to a light and shadow image to dissipate the charge on the areas of the layer exposed to the light, and developing the remaining electrostatic latent image by depositing on the image a finely divided electroscopic marking material sometimes called "toner". Toner will normally be attracted to those areas of the layer which retain a charge, thereby forming a toner image corresponding to the electrostatic latent image. This powder image may then be transferred to a support surface such as paper. Such a transferred image may subsequently be permanently affixed. It is well known that a latent image may be formed on an appropriate surface by direct charging in image configuration. Likewise, one may develop and fix an image to a latent image holding substrate.

Development of an electrostatic latent image may also be achieved with liquid rather than dry developer materials. In liquid development commonly referred to as electrophoretic development, an insulating liquid vehicle having finely divided solid marking material dispersed therein contacts the latent image bearing surface in both charged and uncharged areas. Under the influence of the electric field associated with the charged image pattern, these suspended particles migrate toward the charged portions of the imaging surface thus separating out of the insulating liquid. This migration of charged particles results in the deposition of the marking particles on the imaging surface in image configuration. Electrophoretic development of an electrostatic latent image may, for example, be obtained by flowing the liquid developer over the image bearing surface, by immersing the imaging surface in a pool of the developer, or by presenting the liquid developer on a smooth surfaced roller and moving the roller against the imaging surface. Other development techniques are known.

Another technique for developing latent images by liquid development is known as out-of-contact development. In this method, an electrostatic latent image is developed or made visible by presenting to the imaging surface a liquid developer on the surface of a developer dispensing member having a plurality of raised portions or "lands" defining a substantially regular patterned surface and a plurality of portions depressed below the raised portions or "valleys". The depressed portions of the developer dispensing member contain a layer of liquid developer which is maintained out of contact with the electrostatographic imaging surface. Development is achieved by moving the developer dispensing member loaded with liquid developer into developing configuration with the imaging surface. The liquid developer is believed to be attracted from the depressed portions of the applicator surface in the charged or image areas only. It is also possible to employ a smooth developer dispensing member holding on its surface liquid developer at a predetermined spacing from the image bearing surface. Development is also achieved by developer transferring over to the image bearing surface by attraction.

It is well known that a liquid developer for use in electrophotography comprises a highly electroinsulating liquid or carrier liquid having pigment particles dispersed therein. A resin component is usually incorporated into the carrier liquid to maintain dispersion of the pigment thereby stabilizing its charge state. In the preparation of liquid developers, an intimate mixture or paste of pigment, resin and a small amount of a carrier liquid is first prepared by the aid of a kneader or mixer such as ball mill. The resulting paste is then diluted with carrier liquid to a concentration suitable for the intended purpose and used for latent image development.

When a continuous-tone image is developed using such liquid developers, the pigment contained therein generally is required to be especially fine. To effect a satisfactory dispersion of the fine pigment particles, either powerful milling or mixing for long periods of time is required in the preparation of the paste. However, it has been found that milling long periods of time does not necessarily result in improvement in the characteristics of liquid developers and sometimes detrimental effects are observed. When using a liquid developer prepared by dilution of a paste obtained by such strong milling, the image density of the resulting image is often decreased.

It is an object of this invention to provide for an improved liquid developer. It is a further object of this invention to provide for a process of manufacture for liquid developers containing fine pigment which give images of high density and good resolution. It is yet another object of this invention to provide for stable liquid developers. Other objects and advantages will appear from a full and complete reading of the ensuing specification.

It has been found that the mixing or milling necessary to produce a fine developer causes the formation of impurities in the developer leading to a poorer quality product. These impurities result in a serious decrease in the density of images formed by such developers. Apparently this decrease is caused by the chemical-mechanical destruction of the resinous component in the paste due to milling. This destruction results in the formation of lower molecular weight components, which when mixed with the carrier liquid tend to affect adversely the stability and electrical charge of the developer. This results in a decrease of the density of such images formed in development using these liquid developers.

In accordance with this invention, there is provided a process for the production of a liquid developer for developing electrostatic latent images, characterized by milling a mixture composed predominantly of a pigment, resin, and highly electroinsulating carrier liquid, treating the milled mixture with a polar solvent having a specific dielectric constant of at least 12 to separate impurities and components soluble in the solvent from the mixture, and then dispersing the insoluble matter into a carrier liquid. Any conventional and ordinary inorganic and organic pigment may be used for this invention, excluding those soluble in the carrier liquid or in the polar solvent used in this invention. Carbon black is just one of many useful pigments known.

Utilizable as resin in the milling treatment of this invention are vegetable oil modified alkyd resins, epoxy esters, styrenated alkyd resin, hydrogenated rosin esters, asphalt, styrene/butadiene copolymers, and a variety of vegetable oils. These may be used alone or in mixtures.

These pigments and resins are milled together with a small or minor amount of a carrier liquid in a mill to form an intimate mixture. Mills utilizable for this invention include ball mills, three-roll mills, attriter, vibrating mills, sand mills, colloid mills, and many other conventional mixing devices.

The time required for the milling treatment is generally within a period of about 2 to about 150 hours, preferably within about 5–100 hours, although it depends on the milling conditions. The milled mixture which is a dispersion of the pigment and resin is thus obtained.

In known conventional process for producing such liquid developers for use in elctrophotography, the milled mixture obtained is then diluted with a carrier liquid to an appropriate toner concentration. Any conventionally known carrier liquid may be employed. It is preferred that such liquids have a volume resistivity of greater than about $10^7$ ohm-cm. Decalin, kerosene, cyclohexane, and many isoparaffin hydrocarbons, among others may be employed.

In accordance with this invention, however, the milled mixture obtained is further treated with a polar solvent. Solvents of the alcohol and ketone series are suitable for the polar solvent of this invention. For example, relatively low molecular weight solvents such as methanol, ethanol, propanol, butanol, accetone, methyl ethyl ketone, and diethyl ketone, among others, can be employed. Solvents having a low dielectric constant are not satisfactory as they completely dissolve the resin used in the milling treatment. Accordingly, the specific dielectric constant of the polar solvents usable for this invention is preferably at least 12. Any solvent which removes the low molecular weight components and other impurities is satisfactory for the process of this invention. Thus, the specific materials designated above are merely exemplary of those which can be employed to accomplish the objects of this invention. The polar solvents useful in this invention may be used alone or together in mixtures.

The polar solvent may be mixed with the milled developer paste in any manner to accomplish the objects of this invention. For example, the milled mixture comprising pigment and resin may be stirred in the said solvent. By application of this step, low molecular weight components and ionic substances formed during the milling treatment will dissolve into the polar solvent. Since the majority of the milled mixture is insoluble in the polar solvent and thus precipitates on the bottom of a stirring apparatus when stirring is stopped, separation is easily accomplished. The treatment of the milled mixture with the polar solvent is carried out one or more times as desired. Care should be taken if the polar solvent selected is immiscible with carrier liquid. For example, when the paste-like milled mixture is treated with methanol, the mixture will contain a small amount of methanol which is then dispersed into the carrier liquid. The developer dispersion may however become unstable. In such a case, it may be desirable to treat again the milled mixture, after the first treatment with methanol, with a solvent miscible with carrier liquid, such as, for example, ethanol. The milled mixture thus treated with the polar solvent is then diluted with the carrier liquid.

Any appropriate dilution amount may be employed. Generally from about 1 gram of pigment to about 100 grams of pigment per liter are satisfactory, but other formulations are known and useful in this invention. The same is true for the resins. Any appropriate amount may be employed.

Solvents of the aliphatic or cycloaliphatic hydrocarbon series can be used as carrier liquid in this invention. These solvents possess the general properties required for the carrier liquid, i.e. low dielectric constant and high electric resistance. Chlorofluorinated hydrocarbons, silicone oils, and others can also be used as the carrier liquid.

The liquid developer of this invention is distinguished by giving images of high optical density. The liquid developer possesses good shelf-life and can be used with stability for a long period of time, thus enhancing its practical value. Moreover, it yields images of low fog and high contrast. If necessary, a charge controlling agent such as a metal soap may be added to the liquid developer to yield images which are sharper.

This invention will be illustrated more in detail by way of examples. It is apparent that the proportion and composition of ingredients and procedures illustrated in these examples can be modified by those skilled in the art without departing from the scope of this invention. Thus, it is to be understood that this invention is not limited by these specific examples. All parts and percentages are by weight unless otherwise stated.

EXAMPLE I (Prior Art Demonstration)

The following composition was made:

| | |
|---|---|
| Carbon black (Mitsubishi Chem. Ind. No. 6000) | 18 parts by weight |
| Phthalocyanine Blue | 2 parts by weight |
| Alkyd resin (soybean oil modified, oil length 65%) | 100 parts by weight |
| Hydrocarbons of isoparaffin series (Isopar H, Esso Standard Oil Co.) | 400 parts by weight |

A mixture of the above composition was milled for 96 hours using a ball mill and 15 parts by weight of the resulting black dispersion were diluted with and dispersed into 1000 parts by weight of hydrocarbons of isoparaffin series (Isopar H) to prepare a black liquid developer. Development of electrostatic latent images on the electrophotographic photosensitive layer was performed using the above liquid developer. Said photosensitive layer had a thickness of 6 $\mu$ in dry state and such a structure that photoconductive ZnO was dispersed into a binder which was styrenated alkyd resin link-cured with a diisocyanate. The mixing ratio by weight of said ZnO to said binder resin was about 6:1.

The photosensitive layer was charged at -150V in a dark place using a negative corona discharge, overlaid with the original and then exposed to light at 5000 lux sec. After exposure to light, the surface of the photosensitive layer was washed with clean Isopar E (a volatile solvent of isoparaffin series, Esso Standard Oil Co.) and then dried.

A positive image of the original was thus obtained wherein the optical density of fog was 0.12 and $D_{max}$ was 1.52.

EXAMPLE II (The Invention)

The procedure of Example I was repeated except that 15 parts by weight of the black dispersion obtained by the ball mill treatment were added dropwise with stirring to 300 parts by weight of ethanol. After 5 minutes, cessation of the stirring resulted in precipitation of a black insoluble matter. After removing the mother liquid by decantation, a similar treatment was repeated using 100 parts by weight of ethanol to obtain a black insoluble matter. Ethanol was removed under reduced pressure from the insoluble matter. Isopar H was added to prepare the liquid developer. Using this liquid developer, a similar development treatment as described above was carried out to yield a good positive image in which fog density and $D_{max}$ were 0.09 and 1.87, respectively.

Thus, the treatment with ethanol is found effective for decrease of fog but for increase of image density.

EXAMPLE III

Example II was repeated in every detail except that isopropyl alcohol was used in the place of ethanol. After testing, upon comparison with the control, Example I, it was found that the developer of this example increased the image density and decreased the fog.

EXAMPLE IV

Example II was repeated in every detail except that methanol was used in place of ethanol in the first treatment and then ethanol was used in the second treatment. Upon testing a high quality print was obtained.

EXAMPLE V

Example II was repeated in every detail except that a mixed solvent of ethanol/acetone at an 8:2 ratio was substituted for ethanol. Upon testing a good, high quality image was obtained having a low fog density of 0.09 and a $D_{max}$ of 1.91.

EXAMPLE VI

In place of 100 parts by weight of the alkyd resin in Example II, 50 parts by weight of the alkyd resin and 50 parts by weight of an epoxy ester (Epicosol 807MS, Nihon Coating Co., Ltd.) were substituted and 1000 parts by weight of kerosene were used as carrier liquid instead of Isopar H. The image obtained by using the ethanol-treated liquid developer had fog density of 0.11 and $D_{max}$ of 1.94 while an image obtained by using untreated liquid developer according to Example I had fog density of 0.11 and $D_{max}$ of 1.65.

EXAMPLE VII

Example II was repeated except that a sharper image was produced by using a liquid developer prepared by dispersing the ethanol-treated paste into 1000 parts by weight of Isopar H containing 0.04 part by weight of cobalt napthenate.

From the above examples it should be apparent that the amount of polar solvent employed is not critical. It is generally preferred to treat the paste of pigment and resin with from 10% to about 1000% by volume of solvent.

What is claimed is:

1. A liquid developer composition which is free from impurities comprising pigment, resin, and an electrically insulating carrier liquid wherein the pigment and resin are treated with a polar solvent having a specific dielectric constant of at least about 12 to remove impurities therefrom after milling the same for from about 2 to about 150 hours.

2. A process for preparing liquid developer capable of developing electrostatic latent images comprising milling a mixture of pigment and resin for from about 2 to about 150 hours, treating the milled mixture with a polar solvent having a specific dielectric constant of at least about 12 to remove impurities present therein, and dispersing the insoluble components of the milled mixture into an electrically insulating carrier liquid to form the liquid developer.

3. The process according to claim 1 wherein the solvent is an alcohol.

4. The process according to claim 1 wherein the solvent is a ketone.

5. The process according to claim 1 wherein the solvent is selected from the group consisting of methanol, ethanol, butanol, propanol, acetone, methyl ethyl ketone, diethyl ketone, and mixtures thereof.

* * * * *